United States Patent [19]

Voss et al.

[11] 4,055,419

[45] Oct. 25, 1977

[54] METHOD OF DEVELOPING ELECTROSTATIC IMAGES USING WIDE LATITUDE TONER

[75] Inventors: Charles J. Voss, Addison; Theodore Nykiel, Chicago, both of Ill.

[73] Assignee: Bell & Howell Company, Chicago, Ill.

[21] Appl. No.: 716,744

[22] Filed: Aug. 23, 1976

Related U.S. Application Data

[60] Division of Ser. No. 513,970, Oct. 11, 1974, Pat. No. 3,997,456, which is a continuation-in-part of Ser. No. 304,030, Nov. 6, 1972, abandoned.

[51] Int. Cl.[2] ..... G03G 13/10

[52] U.S. Cl. ..... 96/1 LY; 427/17

[58] Field of Search ..... 96/1 LY; 427/17; 252/62.1 L

[56] References Cited

U.S. PATENT DOCUMENTS

| | | | |
|---|---|---|---|
| 2,839,470 | 6/1958 | Warren | 252/33 |
| 2,856,360 | 10/1958 | Schlicht | 252/33 |
| 3,057,896 | 10/1962 | Schlicht et al. | 252/33 |
| 3,154,560 | 10/1964 | Osuch | 252/51.5 A |
| 3,216,939 | 11/1965 | Cyba | 252/50 |
| 3,219,666 | 11/1965 | Norman | 252/51.5 A |
| 3,362,907 | 1/1968 | Matkan et al. | 252/62.1 L |
| 3,429,811 | 2/1969 | Robbins et al. | 252/33 |

*Primary Examiner*—Roland E. Martin, Jr.
*Attorney, Agent, or Firm*—Robert A. Walsh

[57] ABSTRACT

A method is disclosed for visibly reproducing light or poor images upon an exposed electroconductive surface. A liquid developer is provided, and used in the method, comprising a negative toner material having no cut-off which is deposited on slightly discharged and uncharged areas resulting from exposure to minimum degrees of illumination. The toner material includes electrostatically charged particles in combination with a chemically active liquid solution which solution increases the ability of the particles to adhere to slightly discharged as well as an uncharged surface on the exposed photoconductive paper.

6 Claims, 2 Drawing Figures

METHOD OF DEVELOPING ELECTROSTATIC IMAGES USING WIDE LATITUDE TONER

This is a division of application Ser. No. 513,970, filed Oct. 11, 1974, now U.S. Pat. No. 3,997,456 which is a continuation in part application of Ser. No. 304,030, filed Nov. 6, 1972, now abandoned.

BACKGROUND OF THE INVENTION

This invention relates to electrophotography and more particularly to an improved method and means for making visible a reverse latent image formed by negative electrostatic charges on electrophotograhic plates or surfaces as are known in electrostatic printing. In certain forms of electrophotography, a relatively conductive backing member, such as a paper or metal sheet, has deposited upon its surface a uniform electrostatic charge. The charged surface is then exposed to a radiation pattern whereby the irradiated areas become discharged in accordance with the intensity of radiation, whereas the shielded areas remain charged, and thus form a latent electrostatic image. This latent image is then rendered visible by applying a dry powder developer or toner material suspended in an insulating carrier liquid such that the toner may be attracted and held electrostatically to the charged areas. The developed image may be fixed to the surface of the photoconductive material or transferred to another surface and fixed thereon.

In the prior art it is known to produce both positive and negative liquid developers by suspending a particulate pigment wetted with an oil or resin in an insulating carrier liquid to form the toner material to be deposited electrostatically. A positive developer contains toner material which can be attracted by negative charges and, therefore, can be used, for instance, to develop a latent image formed by such negative electrostatic charges on a charged and exposed zinc oxide coated electrophotographic paper. The resulting image is a facsimile reproduction of the original radiation pattern.

On the other hand, a negative developer contains toner material which can be attracted by positive charges or repelled by negative charges. The negative developer can be applied to a photoconductive layer containing a negative latent image to produce a reversal reproduction of the original radiation pattern by toner repulsion from the image areas holding negative charges, and by deposition of toner particles on the exposed areas which have no or little negative charge. The charged particles depositing themselves on the uncharged and lesser charged surfaces of the photoconductive layer adhere to the layer as a result of Van der Waal forces. Van der Waal forces are the attraction of the molecular forces in the photoconductive sheet or layer to the molecular structure of the toner particles. In this instance, the rate of deposition of the negatively charged toner material is inversely proportional to the magnitude of the negative surface charge retained on the photoconductive surface.

In developing reverse images, the negative toner material is sensitive enough to detect even minute residual changes in charge levels existing on the exposed photoconductive surfaces, and, consequently, such minute changes in charge level result in deposition of toner material according to the intensity of the charge on the photoconductive surface.

In prior developing methods, it has been an object to create a cut-off point in the toner which will prohibit the charged particles from adhering to areas with small charge level differences. In such methods, areas with large negative charges thereon receive no deposition of toner, and, consequently no image appears at these points. However, the present method and means for rendering visible these latent reverse images takes advantage of the inherent capability of the negatively charged particles to adhere to areas where the charge difference is only slight. In this manner, even though background staining may occur and reduce the overall contrast of the ultimately developed reproduction, images which heretofore were not visible in reproduction methods using cut-off toners are rendered visible with the present wide latitude toner. Even though a high density line image is not always obtained in marginal instances with the present toner, borderline visible images, such as produced by poor originals or microfilm reproductions, become visible to the viewer because of freedom from cut-off point in the toner.

In all types of photoreproduction of the type referred to herein, it is unavoidable that the background area on the surface of the photoconductor becomes exposed to some degree of illumination, particularly in the case of low density negatives wherein the background areas are not fully opaque and the image areas are not fully transparent. This exposure of the background areas results in a slight charge reduction. The charge level differences provide the basis for consequent toner deposition of varying degree on these areas using the wide latitude toner of the present invention. While this results in an overall loss in contrast, it, nevertheless, is desirable for the enhancement of the visual capabilities of the reproduced object in borderline areas.

Microfilm reproduction processes usually begin with a poor original which is to be projected on a photoconductive surface, resulting in small differences in illumination on a photoconductive surface. The difference may be small at either end of the spectrum; i.e., where there is either too much or too little light. The object of the present reproduction system is to take the small differences in light and reproduce them without a cut-off at all in the toner used. This permits the borderline images to be reproduced and rendered discernible to the naked eye.

The system to which the present invention is applicable repels negatively charged toner particles from highly negatively charged areas but permits them to deposit upon areas of lesser or no charge where they adhere as a result of Van de Waals forces. However, it is recognized that a poor original may produce images where strong negative charges remain in which case a conventional reversal toner, having a cut-off, would not deposit while the wide latitude toner of the present invention, having no cut-off, would deposit in sufficient quantity to produce an image which otherwise would not have been visible were the toner to have a cut-off.

Prior reversal toner compositions do not surround the charged particle with a chemically active liquid solution to enhance its ability to adhere to a slightly discharged photoconductive surface. Further, in some prior toner materials where a liquid solution is used, it does not become part of the negatively charged particle itself.

Therefore, it is a primary object of the present invention to produce an electrostatic liquid developer which contains negative toner material capable of depositing on slightly discharged, as well as uncharged, areas of a photoconductive surface.

A further object is to provide an electrostatic liquid developer for developing in the reverse sense latent images formed on a surface by negative electrostatic charges which developer contains negative toner material which has no cut-off.

A still further object is to provide an electrostatic liquid developer comprising toner material which enhances the reproduction of light or poor images upon an exposed electroconductive surface.

An additional object of the present invention is to provide an electrostatic liquid toner material which enables deposition of charged particles on uncharged and slightly discharged portions of a photostatic surface as would result from exposure to a small increment of illumination.

Still another object of the present invention is to provide an electrostatic liquid toner material wherein each charged particle mixes with a quantity of a chemically active liquid solution to enhance the ability of the particle to adhere to a slightly discharged as well as an uncharged surface.

Still another object of the present invention is to provide an electrostatic liquid toner material where a chemically active liquid solution is utilized as part of the charged particle.

A developer in accordance with the present invention consists of an insulating carrier liquid having an electrical volume resistivity in excess of $10^9$ ohm cm, and a dielectric constant of less than 3, toner particles suspended in said carrier liquid which particles may comprise non-resinated pigment particles or aggregates of non-resinated pigment particles containing thereon an absorbed layer of a wetting substance and a sensitizing agent. The particles are wetted by a chemically active liquid solution and a soy modified pentaerythritol alkyd resin. The pigment particles are ground in the presence of a chemically active liquid solution, causing them to separate whereupon a mixed layer of liquid solution and resin adheres to the surface of each charged particle and prevents reagglomerization. The liquid solution and resin surrounding each charged particle increases the capability of the particles to adhere to a slightly discharged or uncharged surface on a photoconductive surface.

In order that the functioning of the liquid developer formulated and used in accordance with the present invention may be fully understood, it is necessary to first describe the machanism of developing a latent image. On a surface containing latent images formed by negative electrostatic charges of varying magnitude, there is a flux of a density varying in proportion to the magnitude of negative charge. This flux can be imagined as issuing from the negative latent image areas of the surface in a density proportional to the surface charge magnitude in such area, and re-entering the surface in the exposed non-image areas containing lesser or no residual charges. The density of the re-entering flux in any area is inversely proportional to the magnitude of the residual negative charges present in the area. Positive toner particles deposit along the field line toward the negative charge and their rate of deposition is proportional to the magnitude of the negative charges or to the density of the flux issuing from the charge holding areas, whereas negative toner particles deposit along the field lines toward the point of re-entry and their rate of deposition is inversely proportional to the magnitude of the residual negative electrostatic charges existing in the exposed or partly exposed area. The particles are held to the lesser and under charged surfaces by means of molecular or Van der Waal forces.

It will thus be seen that prior art negative toner particles will not deposit on the unexposed areas retaining negative charges of a maximum magnitude, but toner deposition will take place onto all other areas where the charged magnitude has been reduced by exposure or due to other causes to a magnitude somewhat lesser than the aforesaid maximum. The rate of deposition of the negative, toner that is to say the image deposit in a given area, is, therefore, proportional to the exposure or to the percentage of reduction of the aforesaid maximum charge magnitude; i.e., to the difference between the aforesaid maximum charge magnitude in the unexposed areas, where no toner deposition takes place, and the lesser charge magnitude existing in the given area. The highest density image deposit can be thus attained in the fully exposed areas approaching 100% reduction of the aforesaid maximum charged magnitude retained in the unexposed area.

Prior art toner materials take advantage of the difference between minimum and maximum charges on a surface of photoconductive paper and deposit particles only where the magnitude of the negative charge is below a specified cut-off level. In other areas, no deposition of particles takes place and borderline images, consequently, fail to reproduce. Therefore, it is apparent that there is a need for a negative liquid developer for the production of reverse copies from negatives, which developer contains toner material which is capable of depositing onto areas where there is only a slight reduction in negative charge due to low level illumination of the image areas of the photoconductive surface as in the case of projection exposure from high density negatives.

The quality which differentiates a wide latitude reversal toner from other reversal toners is "cut-off". The present wide latitude toner has practically no cut-off, and will reproduce where there is only a very slight drop in charge on the copy paper surface.

To further explain the functioning of the liquid developer in accordance with this invention, reference is made to the accompanying drawing in which.

Figure 1:
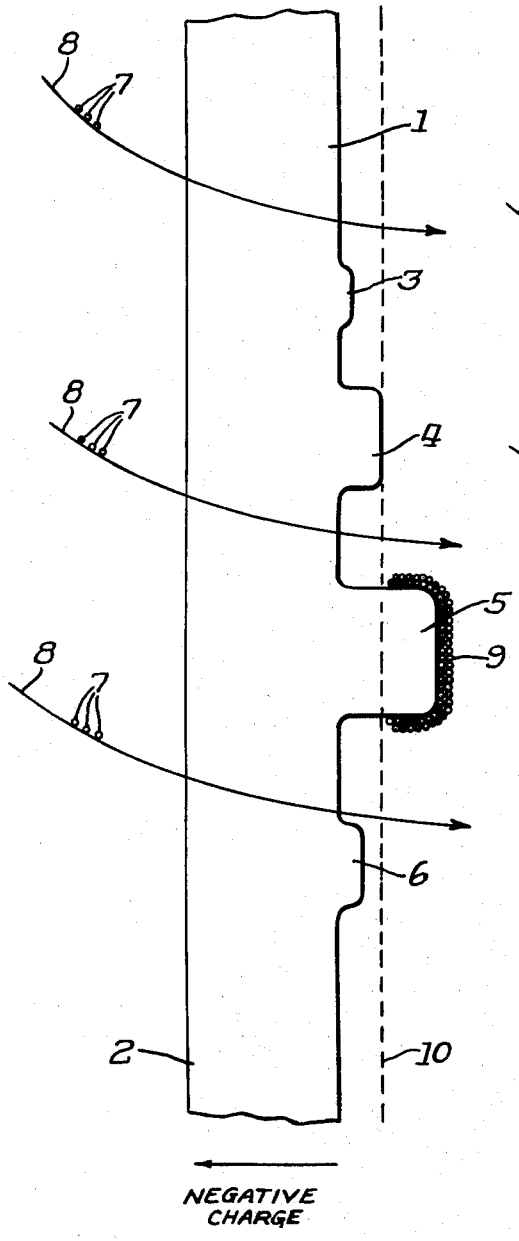
FIG. 1 is a schematic cross-sectional view of a charged photoconductive layer illustrating the deposition of negatively charged particles on uncharged areas of the layer above a cut-off point where a toner having a cut-off capability is utilized.

Referring to FIG. 1, an electrophotographic sheet, such as zinc oxide coated paper, is designated by the numeral 1. The sheet 1 has been charged to a negative potential, whereby the magnitude of the negative charge decreases from the base line 2 toward the right. The sheet 1 has, subsequently, been exposed to a radiation pattern of varying intensity, whereby the initial negative charge has been reduced in the areas, 3,4,5 and 6. The area designated 5 represents the area receiving the highest intensity of radiation, whereby the negative charge in the sheet 1 is reduced practically to zero. The areas 3,4 and 6 have been exposed to lesser magnitudes of radiation, and the original magnitude of negative charge is reduced to only a certain degree in these regions, leaving each area with a residual negative charge.

As a toner is applied to the surface of sheet 1, negatively charged particles 7 in the toner are subject to electrostatic forces. The surface of sheet 1 contains latent images formed by negative electrostatic charges of varying density. As stated previously, there is a flux present which may be considered to exist in a plane perpendicular to that of the sheet 1. This flux is represented by the lines 8 in FIG. 1. Since the particles 7 and the sheet 1 are charged to the same polarity, particles 7 are repelled from the charged areas of the sheet. However, as the magnitude of negative charge in sheet 1 decreases in a given area, charged particles 7 begin to be attracted to uncharged, or relatively smaller charged areas under the influence of intermolecular, or Van der Waal forces. This is illustrated by the numeral 9 in FIG. 1.

The particular illustration of particle deposition in FIG. 1 relates to the use of prior art toners which comprise a "cut-off", or ability not to deposit any particles in an area retaining a specified intensity of negative charge. Such cut-off toners are disclosed in Matkan et al, U.S. Pat. No. 3,362,907. In FIG. 1, the cut-off charge line is designated by the numeral 10, and it is apparent that no areas to the left of this line 10 (representing higher negatively charged areas) receive a deposition of negatively charged particles 7. As a result, the final reproduction will sharply reveal the image represented by the area 5, but the image represented by areas 3,4 and 6 will not appear at all. Therefore, it is evident that with prior art cut-off toners, while maximum contrast in the reproduced image is afforded, light portions of the original image will be completely lost.

Figure 2:
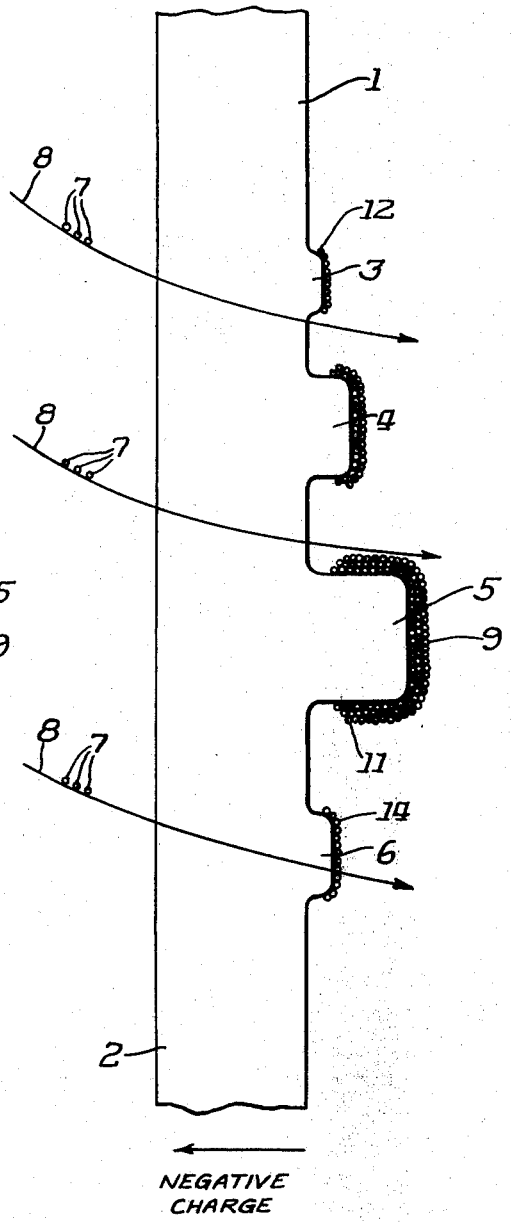
FIG. 2 is a similar view of a photoconductive layer where the toner has no cut-off, illustrating the deposition of negatively charged particles on partially charged, as well as uncharged, areas of the layer.

The toner of the present invention has no cut-off and its use in depositing negatively charged particles on the uncharged and partially charged areas of an electrostatically charged and partially radiated sheet are illustrated in FIG. 2, where like elements are similarly identified. The charged particles 7, as they are repelled by the negative charge on sheet 1, are carried to the right by the force of flux 8. As stated previously, the particles 7 adhere to the uncharged portion of sheet 1, designated 5. However, the toner of the present invention is formulated to comprise no cut-off, and is capable of depositing toner particles on lesser discharge areas which still maintain a residual negative charge due to radiation or illumination from a poor original. As seen in FIG. 1, these areas fall beneath the cut-off line 10, and received no deposition when a cut-off toner was used.

When the toner of the present invention is employed on photoconductive sheet 1, areas 3,4 and 6 receive a deposition of charged particles in inverse proportion to the intensity of the negative charge remaining, as indicated by the numerals 12,13 and 14, respectively. In other words, area 4 will receive more deposition than area 6, while area 6 receives more deposition than area 3. In the resulting reproduction, the image represented by area 9 will appear the sharpest, while the contrast against the background of the image of areas 3,4 and 6 will be progressively less. Nevertheless, these latter images will be visible and discernible, where they were not visible when developed by a toner having a cut-off. Even though the toner of the present invention causes slight background staining, there is sufficient contrast in the reproduced image to render the copy legible.

The formulation of the toner of the present invention differs from prior toners in three respects:

1. The use of a long oil soya modified pentaerythritol alkyd resin for adhesion to non-agglomerated negatively charged pigment particles and the use of dimerized resin.

2. Grinding or milling pigment particles in the presence of the soya modified resin and a sensitizing agent composed of a chemically active liquid solution; and 3. The use of non-resinated pigments, as compared to the use of resinated pigments as are present in the prior toners. The procedure of milling or grinding in the presence of the chemically active liquid solution produces the desired no-cut-off effect. This enables the pigment particles to separate and remain unagglomerated, while particles of the chemically active liquid solution and resin adhere to the surface of each particle to satisfy the unsatisfied attraction forces of the unagglomerated particles. As is known in the art, the chemically active liquid solution also aids in fixing the final image to the reproduced copy.

The following examples of preparing a toner formulation will further illustrate the manner in which wide latitude liquid developers with practically no cut-off can be prepared in accordance with the present invention. It will be understood that this invention is not restricted by the listed materials and combinations thereof, since one skilled in the art of producing electrostatic latitude liquid developers as may be desired for particular applications.

EXAMPLE I

A first example of a wide latitude liquid toner prepared in accordance with the techniques of the present invention includes the following ingredients:

| | | | |
|---|---|---|---|
| | Part 1 | | |
| 1. | Microcrystalline wax | 5.6 | grams |
| 2. | Solution of 1% superbased calcium sulphonate in isoparaffinic hydrocarbon solvent | 21.2 | grams |
| 3. | Long oil soya modified pentaerythritol alkyd resin | 9.6 | grams |
| 4. | Butylated hydroxy-toluene | 1.4 | grams |
| 5. | Phthalocyanine green pigment (C.I. Pigment Green 7) | 4.8 | grams |
| 6. | Carbon black (C.I. Pigment Black 7) | 4.8 | grams |
| 7. | Thioindigoid red pigment (C.I. Pigment Red 88) | 4.8 | grams |
| | Part 2 | | |
| 1. | Long oil soya modified pentaerythritol alkyd resin | 24.0 | grams |
| 2. | Pentaerythritol ester of dymerex (dimerized rosin) (50% in Enco Aromatic S-100) | 16.8 | grams |
| 3. | Solution of 1% calcium sulphonate in isoparaffinic hydrocarbon solvent | 106.8 | grams |

It has been found that the comparative quantity of superbased calcium sulphonate - isoparaffinic hydrocarbon solvent mixture in Part 1 and Part 2 of Example I may vary so long as the relative percentage quantity of calcium sulphonate in the total mixture remains the same. It has further been discovered that appreciable wide latitude reproduction characteristics can be produced by a toner having substantially the same composition as Example I, except where the relative amount of superbased calcium sulphonate in solution with the isoparaffinic hydrocarbon solvent is varied within the range of ½% to 20%.

There are many patents which extensively, and in detail, set forth methods for producing superbased alkaline earth metal sulphonates of the type used in my invention. See, for example, the disclosures contained in U.S. Pat. Nos. 2,467,176, 2,616,905, 2,695,910, 2,839,470, 2,856,360, 3,057,896 and 3,429,811.

To prepare the liquid toner of Example I, the microcrystalline wax is melted and stirred into a chemically active liquid solution, such as the calcium sulphonate - solvent solution (21.2 gram portion). The wax aids in the dispersion of the pigment particles when the compound is mixed, and also prevents re-agglomeration after the particles are dispersed by the mixing procedure. Next, 9.6 grams of long oil soya modified pentaerythriotol alkyd resin are stirred in. After these ingredients are completely mixed, 1.4 grams of butylated hydroxy-toluene are added and blended. The latter constituent acts as an oxidation inhibitor in the compound, and the combination of wax-oil, alkyd resin, and butylated hydroxytoluene acts as a binding base in the toner produced in accordance with the present invention. The calcium sulphonate-solvent solution plasticises the slurry compound, thus prepared for milling.

For the purpose of image forming, the following non-resinated pigments are added to the above slurry and stirred until completely wetted; i.e., no dry pigment shows:

a. Phthalocyanine green pigment, 4.8 grams
b. Carbon black, 4.8 grams
c. Thioindigoid red pigment, 4.8 grams The pigment particles are wetted for the purpose of conveyance, and also for keeping the pigment particles in the mixture.

The phthalocyanine green pigment is of the type sold under the tradename Microlith Green GT, which is a pigment coated with Staybelite Ester 10 resin, made by Ciba. The thioindigoid red pigment is of the type sold under the tradename Microlith Bordeaux RT, also coated with Staybelite Ester 10 resin. The carbon black may be of the type sold under the tradename Microlith Black CT.

The slurry thus far prepared is transferred to a 3-roll mill and given six passes until a particle size of $0.3 \neq 0.05$ mils is obtained. The mixing step in the presence of the calcium sulphonate - solvent solution is important since the carbon black and other pigments are small to begin with and adhere to one another through cohesion in the slurry; i.e., they are agglomerated. The grinding step applies shearing forces and the particles disperse or separate. While separated, they are wetted by the calcium sulphonate or the calcium sulphonate - solvent solution and resin to maintain their separate status. As a result, molecules of the calcium sulphonate or calcium sulphonate - solvent solution and molecules of the resin are attached to the surfaces of each unagglomerated pigment particle.

The separated, negatively charged pigment particles have attracting forces associated with each particle which must be satisfied or re-agglomeration will occur. If allowed to reagglomerate, these cohesion or attraction forces are satisfied by the particles being drawn toward one another again. However, in the present formulation, these attraction forces are satisfied by each particle picking up a layer of calcium sulphonate or calcium sulphonate - solvent solution and resin which adheres to the surface of each negatively charged pigment particle, and satisfies the attraction forces. Therefore, there is no reagglomeration and the particles maintain a separate status in the mixture. At the present stage of formulation of the toner in accordance with Example I, the pigment particles remain separated and are surrounded by a film of calcium sulphonate or calcium sulphonate - solvent solution and resin.

Next, the 24.0 grams of long oil soya modified pentaerythritol alkyd resin is blended into the 16.8 grams of dimerized resin which is in solution with an aromatic solvent, such as 50% Enco Aromatic S-100 oil. The resin at this stage is added to prevent shock and to help fix the image. In addition, the resin adheres to the particles which have previously been introduced to the alkyd resin. The resin that is used in Example I is a hydrocarbon soluble resin such that the image finally produced will not be disturbed. The quantity of aromatic solvent used is limited to that required to solubilize the pentaerythritol ester of dimerized resin. After these are completely blended, 106.8 grams of a solution of 1% calcium sulphonate in isoparaffinic hydrocarbon solvent is added and mixed in thoroughly. This additional calcium sulphonate - solvent solution acts as a fixing agent, as a general control agent, and as an anti-shock agent. This solution is worked slowly into the previously prepared mixture to prevent lumps, and the two are stirred for one-half hour. The resultant mixture is called the "mill base".

To convert the mill base to concentrate, a mixture of 157 grams of isoparaffinic hydrocarbon solvent and 9 grams of Aromatic S-100 oil per 100 grams mill base is prepared. This solvent mixture is blended slowly into the mill base and then allowed to mix one-half hour.

To produce toner of working strength, dilute one part of the concentrate previously prepared with 8 parts of isoparaffinic hydrocarbon solvent while the latter is being stirred.

EXAMPLE II

A second form of wide latitude toner is produced by using substantially the same ingredients and mixing procedure set forth in Example I, except that the solution of 1% superbased calcium sulphonate in isoparaffinic hydrocarbon solvent in Part 1 and Part 2 is deleted in the formulation and replaced by similar quantities of a solution comprising 15% to 25% inclusive nitrogen substituted long chain alkenyl succinamide in isoparaffinic hydrocarbon solvent. The alkenyl succinamide used is a common detergent inhibitor found in motor oils.

The nitrogen substituted long chain alkenyl succinamides are those selected from the class consisting of the reaction products of alkenyl succinic anhydrides with polyanimes (U.S. Pat. Nos. 3,172,892, 3,024,237), other amines (U.S. Pat. No. 3,219,666), and the reaction products of alkenyl succinic anhydrides with polyamines and carboxylic acids (U.S. Pat. No. 3,216,936).

Experimentation has shown that the comparative quantity of alkenyl succinamide - solvent mixture in Part 1 and Part 2 of the toner compound of Example II may vary so long as the relative percentage quantity of alkenyl succinamide in the total mixture remains the same. It has further been discovered that appreciable wide latitude toner reproduction characteristics can be produced by a toner having substantially the same composition as Example II, except where the relative amount of nitrogen substituted long chain alkenyl succinamide in solution with the isoparaffinic hydrocarbon solvent is varied within the range of 10% to 70%.

EXAMPLE III

A third form of wide latitude toner is produced by using substantially the same ingredients and mixing procedure set forth in Example I, except that the solution of 1% superbased calcium sulphonate and isoparaffinic hydrocarbon solvent is replaced by a detergent mineral oil containing, inter alia, superbased calcium sulphonate, such as 10 W 30 Enco, in the same quantities as set forth for the calcium sulphonate - solvent solution of Part 1 and 2 of Example I.

It has been noted that the toner solution prepared in accordance with the above examples produces pigment particles which have a capacity to adhere to uncharged and slightly charged areas of an electrostatic sheet in accordance with Van der Waal forces, as described above. The chemically active liquid solution and resin film surrounding each particle enhances the particles' ability to adhere to surfaces where a residual charge remains, thereby producing a reproduction wherein marginal images on an original document appear on the reproduced document in a legible fashion. The toner has practically no cut-off and, therefore, will result in an least some deposition on those areas of higher negative charge on the photoconductive surface. As stated previously, some background staining does appear; however, the resultant weak areas in the original are sufficiently contrasted against the background in the copy to be legible.

We claim:

1. The method of rendering visible the reverse sense electrostatic patterns contained on a surface in the form of negative electrostatic charges of varying intensity comprising contacting said surface with a liquid developer consisting of a carrier liquid having an electrical volume resistivity in excess of $10^9$ ohm cm and a dielectric constant of less than 3, said liquid carrier having suspended therein non-resinated toner pigment particles, said liquid carrier having dissolved therein a sensitizing agent selected from the group consisting of ½% to 20% inclusive overbased calcium sulfonate in isoparaffinic hydrocarbon solvent and 15% to 25% inclusive nitrogen substituted long chain alkenyl succinamide in isoparaffinic hydrocarbon solvent, said toner particles including phthalocyanine green, carbon black, and thioindigoid red, and having a negative polarity whereby said toner particles are attracted to the area on said surface of no less than minimum of said electrostatic charge such that toner deposition takes place onto areas defined by said electrostatic pattern where the intensity of said negative electrostatic charges has been reduced or is zero by exposure to electromagnetic radiation, wherein said toner particles are milled in the presence of said sensitizing agent and a long oil soya modified pentaerythritol alkyd resin, whereby said toner particles become dispersed and have adsorbed thereon a film of said sensitizing agent.

2. The method according to claim 1 wherein said sensitizing agent is 1% overbased calcium sulfonate in isoparaffinic hydrocarbon solvent.

3. The method according to claim 1 wherein said sensitizing agent is a mineral oil containing overbased calcium sulfonate.

4. The method according to claim 1 wherein said milling of said toner particles further takes place in the presence of pentaerythritol resin, and said resin and said sensitizing agent are adsorbed upon the surfaces of said dispersed toner particles.

5. The method according to claim 4 having an additional quantity of a long oil soya modified pentaerythritol alkyd resin blended therein subsequent to said milling of said toner particles.

6. the method according to claim 5 wherein said additional long oil soya modified pentaerythritol alkyd resin is a pentaerythritol ester of dimerized resin.

* * * * *